US006427700B1

(12) United States Patent
Leone et al.

(10) Patent No.: US 6,427,700 B1
(45) Date of Patent: Aug. 6, 2002

(54) MASCARA BRUSH, CONTAINER, AND METHOD

(75) Inventors: Erlinda Dugaduga Leone, Chestnut Ridge, NY (US); Hernando Brieva, Manalapan, NJ (US)

(73) Assignee: Revlon Consumer Products Corporation, New York, NY (US)

( * ) Notice: Subject to any disclaimer, the term of this patent is extended or adjusted under 35 U.S.C. 154(b) by 0 days.

(21) Appl. No.: 09/567,460

(22) Filed: May 8, 2000

(51) Int. Cl.[7] ..... A45D 40/26; A46B 11/00
(52) U.S. Cl. ..... 132/218; 132/320; 401/129
(58) Field of Search ..... 132/218, 313, 132/317, 320; 401/129, 128, 127

(56) References Cited

U.S. PATENT DOCUMENTS 4,733,425 A * 3/1988 Hartel et al. ..... 15/206
4,861,179 A * 8/1989 Schrepf et al. ..... 132/218
4,887,622 A 12/1989 Gueret ..... 132/320
4,927,281 A * 5/1990 Gueret ..... 401/129
4,993,440 A * 2/1991 Gueret ..... 132/218
5,161,555 A * 11/1992 Cansler et al. ..... 132/218
5,238,011 A 8/1993 Gueret ..... 132/218
5,370,141 A 12/1994 Gueret ..... 132/218
5,490,529 A * 2/1996 Fitjer ..... 132/218
5,567,072 A * 10/1996 Dunleavy et al. ..... 401/129
5,595,198 A * 1/1997 Kemmerer ..... 132/218

* cited by examiner

*Primary Examiner*—Gene Mancene
*Assistant Examiner*—Robyn Kieu Doan
(74) *Attorney, Agent, or Firm*—Julie Blackburn

(57) ABSTRACT

A brush for the application of mascara to the eyelashes comprised of a central core of twisted metal wire, having gripped therebetween at least two types of fibers which extend radially from the core, wherein the first fiber has a cross-sectional diameter of less than 4 mils and the second fiber has a cross-sectional diameter of greater than 10 mils; and a mascara application system.

21 Claims, 1 Drawing Sheet

MASCARA BRUSH, CONTAINER, AND METHOD

TECHNICAL FIELD

The invention is in the field of brushes for application of mascara to the eyelashes, mascara applications systems, and a method.

BACKGROUND OF THE INVENTION

Mascara both lengthens and thickens lashes. In order to obtain optimal results, ideally each lash should be liberally and uniformly coated with mascara, and the lashes should not clump together. In general, the more thickly mascara is applied, the greater the tendency is for the lashes to clump together. Brushes which are designed to provide thick application of mascara often have bristles spaced so closely together that the lashes cannot penetrate the bristle face to exert a combing effect on the lashes as the mascara is applied. This contributes to clumping. On the other hand, brushes with fewer bristles permit eyelashes to pass through the bristle face as mascara is applied, and thereby exert a combing effect. However, due to the reduced bristle density on such brushes, they are often not capable of thickly coating mascara onto the eyelashes because there are fewer bristles onto which mascara is loaded. A number of patents exist that address different ways of improving the application of mascara onto eyelashes while minimizing difficulties such as lash clumping and uneven distribution.

U.S. Pat. No. 5,063,947 teaches mascara brushes made from a variety of filaments, which are then subjected to rotary grinding which causes the fiber ends to become "shredded". The patentee claims that the shredded fiber ends provide hooks, which are additional reservoirs for mascara. Then, when the brush is used to apply mascara to the lashes, the additional mascara in the reservoirs will be applied to the lash also causing heavier application. While the additional reservoirs provided by the hooks may theoretically hold additional mascara, it has been found that the mascara does not readily release from such reservoirs when the brush is stroked against the lashes. In addition, shredded ends, or hooks, provide safety issues in that they could cause eye damage if accidentally poked into the eye, particularly if the fiber used to make the brush has a larger, hence stiffer, cross-section.

U.S. Pat. No. 4,927,281 teaches mascara brushes made from fibers which have capillary channels. The patentee claims that the capillary channels provide additional reservoirs for mascara. When the brush is dipped into the mascara, it fills the reservoirs. When the brush is stroked against the lashes, the mascara in the reservoirs is alleged to deposit onto the lashes. While the theory behind such a brush design is good, as a practical matter the mascara tends to become lodged into the channels, and does not release the desired bigger load of mascara to the lashes.

A variety of other patents deal with mascara brush designs that allegedly provide better application of mascara to the lashes without the drawback of lash clumping or uneven distribution. However, none of the current brush designs is optimal for this purpose.

The object of the invention is to provide a mascara brush which is capable of applying a liberal coat of mascara to the eyelashes, yet with reduced clumping of the lashes and uneven distribution of product.

The object of the invention is to provide a mascara brush made of fibers having two or more different cross sectional diameters causing the resulting brushes to provide excellent combing and application of mascara to the lashes.

The object of the invention is to provide a mascara brush made of at least two different types of fibers, where one fiber type provides a combing effect to the lashes and the other fiber type provides improved application of mascara bulk to the lashes.

The object of the invention is to provide a mascara brush made from larger cross-section fibers which are capable of providing a combing effect to lashes, yet do not pose a safety hazard.

SUMMARY OF THE INVENTION

The invention is directed to a brush for the application of mascara to the eyelashes comprised of a central core of twisted metal wire, having gripped therebetween at least two types of fibers which extend radially from the core, wherein the first fiber has a cross-sectional diameter of less than 4 mils and the second fiber has a cross-sectional diameter of greater than 10 mils.

The invention is also directed to a mascara application system comprising, in combination;

a) a reservoir for mascara containing one opening, b) a closure for said reservoir, said closure having and inner surface and an outer surface, c) a wand having a proximal end comprised of a stem which is affixed to the inner surface of said closure and a distal end having affixed thereto a brush comprised of twisted metal wire having gripped therebetween at least two types of fibers which extend radially from the core, wherein the the first fiber has a cross-sectional diameter of less than 4 mils and the second fiber has a cross-sectional diameter of greater than 10 mils.

DETAILED DESCRIPTION

Figure 1:
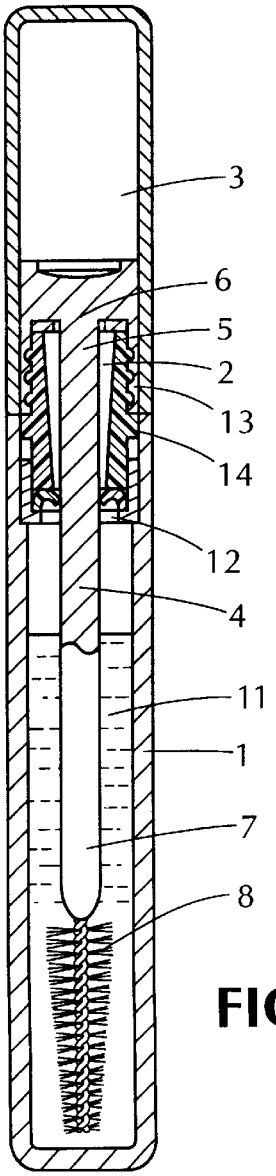
FIG. 1: is a cross-sectional view of the mascara brush and container in accordance with the invention.
Figure 3:
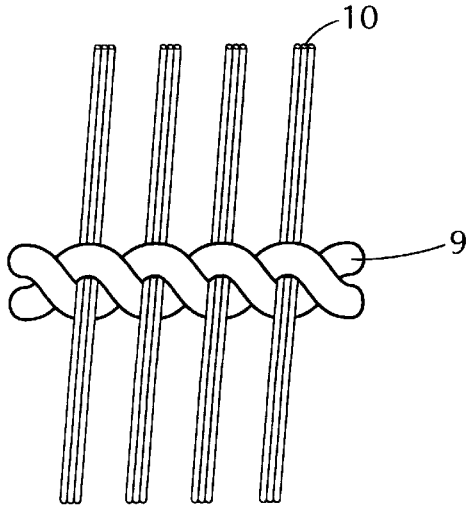
FIG. 3: is a close up illustration of the twisted metal wire brush containing two types of fibers.
Figure 4:
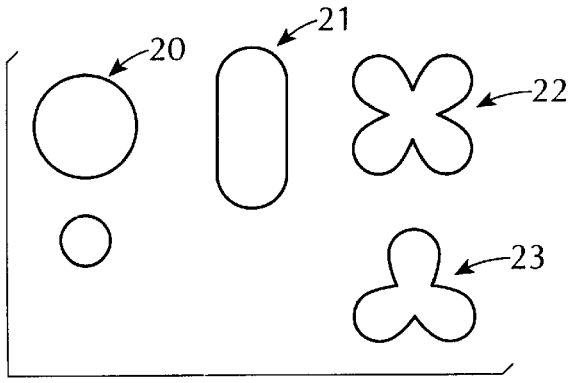
FIG. 4: illustrates the cross-sectional shapes of some of the types of fibers that may be used to make the brushes of the invention.

FIG. 1 shows a cross-sectional view of the mascara container and brush of the invention. Typically, the container comprises a reservoir for mascara 1 containing one opening 2. There is a closure 3 for the reservoir for mascara 1. Attached to the closure 3 is a wand 4. The proximal end 5 of the wand 4 is attached to the inner surface 6 of the closure 3. The distal end 7 of the wand 4 has affixed thereto a brush 8 comprised of twisted metal wire 9 having gripped therebetween at least two types of fibers 10. One type of fiber has a cross-sectional diameter of less than 4 mils, preferably about 2 to 3.9 mils, more preferably about 2.5 to 3 mils. The term "mil" means thousandths of an inch. The second type of fiber has a cross-sectional diameter that is greater than 10 mils, preferably 10.1 to 14 mils, more preferably 11 to 12 mils. Most preferred are mascara brushes made from a mixture of fibers having a cross sectional diameter of 3 mils and 11 mils. The fibers used may be circular solid or hollow, or have varying cross-sectional shapes such as square, oblong, quadrilobal or tetralocular, trilocular, seahorse, and so on. FIG. 4 illustrates the various types of cross-sectional shapes, e.g. solid circular 3 and 11 mil, 20, oblong 21, and tetralocular 22, and trilocular 23. The tetralocular and trilocular fibers used are those described in U.S. patent application Ser. No. 09/294,107, filed Apr. 19, 1999, entitled Mascara Brush, Container and Method, which is hereby incorporated by reference in its entirety. In the case where the fiber cross-section has an irregular shape, the cross-sectional diameter of the fiber is measured at its widest point. The fibers may be made of any thermoplastic polymeric material such as nylon, polyester, polytetrafluoroethylene, polyethylene, polypropylene, and so on. Preferably the fibers are made of nylon, in particular nylon 6–10 or nylon 6–12.

When the closure 3 is attached to the reservoir for mascara 1 so that the container is in the closed position, the brush 8 is immersed in the mascara bulk 11. Generally, the reservoir for mascara 1, which is preferably a vial, contains a wiper 12 which is is formed from a synthetic thermoplastic material that has memory, i.e. is capable of flexure to permit removal of the brush and which returns to its original size and shape, and has a diameter slightly less than that of the brush 8 such that when the brush 8, is pulled through the wiper 12, excess mascara is removed from the brush. Typically, the closure 3 is affixed to the reservoir for mascara 1 by mating screw threads 13 on the closure 3 with similarly sized and shaped screw threads on the neck of the reservoir 14 thereby forming an air tight seal.

Figure 2:
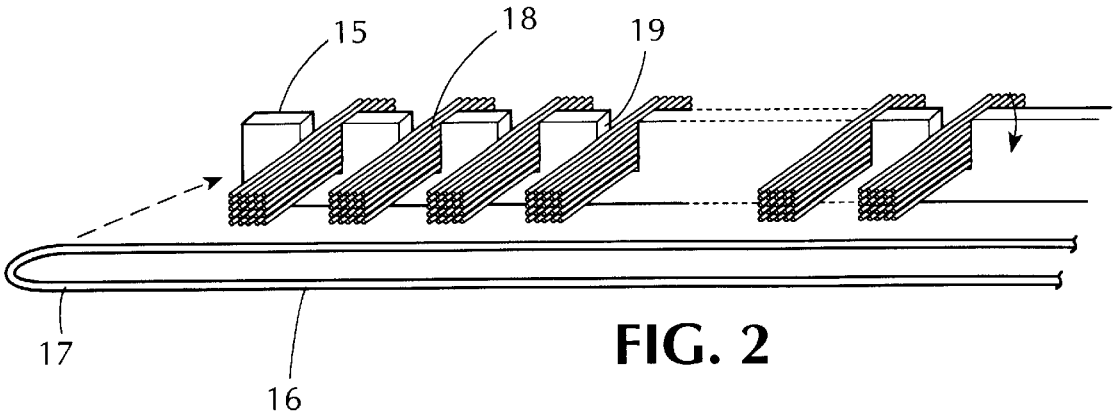
FIG. 2: is an illustration of one intermediate step in the manufacture of mascara brushes in general.

The mascara brush 8 is made using traditional machinery known in the art for this purpose. One type of machine that may be used to make such brushes is a Zahoransky MA1, made by Zahoransky GmbH in Todtnau Germany. The cut fibers used to make the brush are purchased in the form of small bundles of fibers which are cut into sections and contained in containers called pucks. The fibers in the puck are loaded into a retaining device in the machine called a magazine (not shown), which has a floor that slides back and forth (not shown) to permit the fibers to fall from the magazine into a device referred to as a rake 15 as depicted in FIG. 2. The rake 15 contains depressions 19 into which the fibers 18 fall. The machine bends a metal wire 16 into a bobby pin or U-shape 17. The fibers 18 in the rake 15 are then slipped between the arms of the U shaped metal wire 17. The two ends of the wires are gripped by the machine, and the wires are twisted to form the brush. Another type of machine that may be used to make the brush is a Zahoransky MA100 which operates in essentially the same fashion except that the fibers are purchased on spools having a certain number of fibers per spool. The spooled fibers are fed into the machine and positioned between the U-shaped wire, then cut. The ends of the U-shaped wire are then twisted in the same manner to yield a brush. The brush is then trimmed to the desired shape and is ready for affixing to the wand 4. In the case where the Zahoransky MA1 is used, the magazine is loaded with the contents of two different pucks containing fibers having the two different cross-sectional diameters specified. In the case where the Zahoransky MA100 is used, there will be at least two different spools of fiber used, one of each spool having the fiber of the cross-sectional diameter specified. Fibers 18 may be made from any synthetic material such as nylon, polyester, polytetrafluoroethylene, or a similar synthetic material.

The wire 16 used to make the brush 8 generally has a diameter from 15 to 33 mils, preferably 20 to 30 mils. The brush 8 may have a fiber density ranging from about 20 to 800 fibers per ¼ inch of brush length, preferably 25 to 500 fibers per ¼ inch brush length. Most preferred is where the brush has a fiber density of about 60 to 200 fibers per ¼ inch of brush length, i.e. so that in a brush having a length of 1 inch, there would be about 240 to 800 total fibers. Preferred fibers are a mixture of 3 mil and 11 mil fibers. Generally, the brush will contain from about 10–90% 3 mil fiber and 90–10% 11 mil fiber. In general, the brush will contain more 3 mil fibers than 11 mil fibers because the smaller fiber diameters tend to fill the rake more readily than those with larger fiber diameters. Preferably, the brush contains about 30–50% 11 mil fibers and about 50–70% 3 mil fibers, both fibers being nylon 6–12. Fibers having these specifications are available from various suppliers including DuPont. Preferred brushes will have about 10 to 22 turns of the wire helix, the turns holding the fibers in place.

The mascara brushes made according to the invention provide better application of mascara and improved combing of the lashes. The result is more thickly applied mascara with no clumping.

We claim:

1. A brush for the application of mascara to the eyelashes comprised of a central core of twisted metal wire, having gripped therebetween at least two types of fibers which extend radially from the core, wherein the first fiber has a cross-sectional diameter of less than 4 mils and the second fiber has a cross-sectional diameter of greater than 10 mils.

2. The brush of claim 1 wherein the first fiber and the second fiber are synthetic fibers.

3. The brush of claim 2 wherein the first fiber and the second fiber are both nylon.

4. The brush of claim 1 wherein the first fiber has a cross-sectional diameter of 2 to 3.9 mils.

5. The brush of claim 1 wherein the second fiber has a cross-sectional diameter of 10.1 to 14 mils.

6. The brush of claim 4 wherein the first fiber has a cross-sectional diameter of 2.5 to 3.5 mils.

7. The brush of claim 5 wherein the second fiber has a cross-sectional diameter of 11 to 12 mils.

8. The brush of claim 1 wherein the first and second fiber have a solid circular cross-sectional shape.

9. The brush of claim 1 wherein the twisted metal wires are stainless steel.

10. The brush of claim 9 wherein the twisted metal wires have a diameter of 15 to 33 mils.

11. The brush of claim 1 wherein the fiber density is about 25 to 800 fibers per ¼ inch of brush length.

12. The brush of claim 1 which contains about 10–90% of the first fiber having a cross-sectional diameter of 3 mils and about 10–90% of the second fiber having a cross-sectional diameter of 11 mils.

13. The brush of claim 12 which contains about 50–70% of the first fiber and about 30–50% of the second fiber.

14. A mascara application system comprising, in combination;

a) A reservoir for mascara containing one opening, b) a closure for said reservoir, said closure having an inner surface and an outer surface, c) a wand having a proximal end comprised of a stem which is affixed to the inner surface of said closure and a distal end having a brush comprised of two twisted metal wires having gripped therebetween at least two different types of fibers which extend radially from the core, wherein the first fiber has a cross-sectional diameter of less than 4 mils and the second fiber has a cross-sectional diameter of greater than 10 mils.

15. The system of claim 14 wherein the first fiber has a cross-sectional diameter of 2 to 3.9 mils.

16. The system of claim 14 wherein the second fiber has a cross-sectional diameter of 10.1 to 14 mils.

17. The system of claim 14 wherein both types of fibers are nylon.

18. The system of claim 14 wherein the brush contains 50–70% of the first fiber and 30–50% of the second fiber.

19. The system of claim 14 wherein the fiber density of the brush comprises about 20 to 800 fibers per quarter inch of brush material.

20. The system of claim 14 wherein the diameter of the wire core is 15 to 33 mils.

21. The system of claim 14 wherein the first and second fibers have a solid circular cross section.

* * * * *